US006913063B2

(12) United States Patent
Ulerick

(10) Patent No.: US 6,913,063 B2
(45) Date of Patent: Jul. 5, 2005

(54) APPARATUS AND METHOD FOR INSERTING PARTS INTO A MOLD

(75) Inventor: Christopher E. Ulerick, Troy, MO (US)

(73) Assignee: Toyota Motor Manufacturing North America, Inc., Erlanger, KY (US)

( * ) Notice: Subject to any disclaimer, the term of this patent is extended or adjusted under 35 U.S.C. 154(b) by 166 days.

(21) Appl. No.: 10/405,656

(22) Filed: Apr. 2, 2003

(65) Prior Publication Data

US 2004/0194905 A1 Oct. 7, 2004

(51) Int. Cl.[7] ..... B22C 9/08; B22D 33/04

(52) U.S. Cl. ..... 164/134; 164/137; 164/339; 164/358

(58) Field of Search ..... 164/134, 137, 164/339, 340, 358, 412

(56) References Cited

U.S. PATENT DOCUMENTS

| | | | | |
|---|---|---|---|---|
| 787,623 A | | 4/1905 | Hood | 221/174 |
| 927,180 A | | 7/1909 | Simmons | 294/97 |
| 1,030,066 A | | 6/1912 | Erlandson | 164/358 |
| 1,326,936 A | | 1/1920 | Jeans et al. | 266/99 |
| 2,048,144 A | | 7/1936 | Showers, Jr. | 294/81.3 |
| 2,657,571 A | | 11/1953 | Looze | 52/749.13 |
| 3,598,732 A | | 8/1971 | Foster et al. | 210/499 |
| 4,112,997 A | | 9/1978 | Chandley | 164/119 |
| 5,758,710 A | | 6/1998 | Landua et al. | 164/200 |
| 6,540,005 B1 | * | 4/2003 | Daussan et al. | 164/58.1 |
| 6,619,374 B1 | * | 9/2003 | Morishita et al. | 164/412 |

FOREIGN PATENT DOCUMENTS

| | | | | |
|---|---|---|---|---|
| JP | 1-266942 | * | 10/1989 | B22C/9/08 |

* cited by examiner

*Primary Examiner*—Kevin P. Kerns
(74) *Attorney, Agent, or Firm*—Dinsmore & Shohl LLP

(57) ABSTRACT

A dispensing arrangement for inserting a part into a cast iron mold includes a dispenser apparatus configured to dispense a predetermined number of parts, a staging apparatus configured to position the parts in a selective orientation and a jig apparatus configured to grip and lift the parts from the staging apparatus and position the parts in a die of a mold. The apparatus may be located adjacent the mold in use.

14 Claims, 5 Drawing Sheets

APPARATUS AND METHOD FOR INSERTING PARTS INTO A MOLD

FIELD OF THE INVENTION

This invention relates to an apparatus for inserting a part into mold. More particularly, this invention relates to an apparatus configured to dispense, position, grab and insert a plurality of parts into a mold in predetermined spaced positions, such as filter screens into a cast iron mold.

BACKGROUND OF THE INVENTION

In die casting processes such as for aluminum and alloy manufacturing processes, channels are cut in a permanent mold assembly to form a sprue/gating system to fill a die casting part mold (such as for a cylinder head for a vehicle). Molten metal is generally ladled into the mold and fed by either gravity or under pressure, and generally the molds are filled as quickly as practical so as to fill all of the mold cavities in an efficient manner prior to "freezing" of the metal. In this process, a smooth, streamlined flow of material is critical to minimize undesirable interaction of the flowing molten metal with the atmosphere or with the mold itself. For example, turbulent flow can erode the mold walls and/or trap particles in the molten material. Similarly, oxygen in the air can react with aluminum, manganese, or silicon dissolved in steel to form oxide particles which can harm the mold and/or make the resulting cast product weak and/or flawed.

In order to assist in proper filling of the mold and flow of material through the mold runners, sprues and gates, a small piece of light gauge steel or tin mesh (sometimes called a "screen") is often placed in various portions of the mold to allow the various portions of the distribution system and the mold itself to fill in a controlled manner and with "clean" metal (i.e., without debris or other particles).

In the prior processes, an operator would be required to manually place a plurality of screens in the die one by one. Because these small screen pieces are relatively difficult to handle while wearing protective (gloves) generally needed around the harsh environment of working die casting molds), and due to the desire for fast cycle times in manufacturing processes of this type, delays caused by this relatively time-consuming and cumbersome task generally slowed the process down and sometimes caused workers to inadvertently attempt to speed up other processes (e.g., the placement of expendable mold cores and the like) causing undue breakage, waste, shop area uncleanliness and the like. The task of individually placing screens in the die cavities could also be physically demanding and stressful for the labor force. Due to the small size, lightweight and rough surfaces of the mesh screens, it can also be difficult for a worker to physically pick up the proper number of screens (e.g., four) from a stack of screens, causing further delay and frustration in the process. As will be understood, the rough screens often stick to heavy gloves and are difficult to place within the die in proper position with gloves on.

In addition, between each "shot" of the die casting process, the die must be cleaned to remove debris from a previous shot. When cleaning the die, however, the worker must cover each sprue to ensure that debris from the previous shot does not get into the mold. Heretofore, a jig with an appropriate number plates at each end has been used to cover each sprue when cleaning the die. However, placing such jig in the die, cleaning the die, removing the jig and then manually positioning the screens in each sprue is very time consuming and inefficient.

As such, there is a desire for an apparatus capable of increasing the efficiency of the die casting process thereby eliminating the aforementioned issues.

SUMMARY OF THE INVENTION

Accordingly, the present invention is intended to address and obviate problems and shortcomings and otherwise improve previous apparatuses and processes for placing screens into the die of a cast iron mold.

To achieve the foregoing and other objects and in accordance with the exemplary embodiments of the present invention, a dispensing arrangement for inserting parts into a mold may comprise a jig apparatus configured to grip and insert the parts into a mold, a dispenser apparatus configured to dispense a predetermined number of parts and a staging apparatus configured to position the predetermined number of parts in a selected orientation so that the jig apparatus may grip the predetermined number of parts.

To further achieve the foregoing and other objects in accordance with other exemplary embodiments of the present invention, a jig apparatus for placing a plurality of screens in a plurality of predetermined locations in a cast iron mold may comprise a frame having a longitudinal chassis including spaced ends and a handle associated with the chassis. Each of the spaced ends may have a plurality of spaced nodes. The jig may further comprise a backing plate located adjacent to each of the nodes and having a support surface and a releasable gripper associated with each of the backing plates. The gripper may have engaged and disengaged positions and may be configured to selectively secure a screen against the support surface when in an engaged position. In addition, the jig may comprise a release assembly configured to selectively and simultaneously move a plurality of grippers to their disengaged position.

To still further achieve the foregoing and other objects and in accordance with the exemplary embodiments of the present invention, a dispenser apparatus for delivering a predetermined plurality of screens for use in a cast iron mold comprises an actuation arm having a working end. The actuation arm may be reciprocally mounted on a base for selective reciprocation between dispensing and collecting positions. The dispenser may further comprise an actuation arm biasing member configured to normally maintain the arm in one of its dispensing or collecting positions and a magnet associated with the working end of the actuation arm configured to collect the predetermined plurality of screens. The dispenser may further comprise a reservoir associated with the base for receiving a stack of screens, and an actuator handle associated with the actuator arm and configured so that when the actuator handle is moved to the other of the dispensing or collecting positions, the working end will be brought into close proximity to the reservoir, whereby the magnet attracts the predetermined plurality of screens.

To still further achieve the foregoing and other objects of the present invention, a staging apparatus for positioning a plurality of screens may comprise a base having a plurality a screen staging stations, each of the screen staging stations having at least one slot for receiving a jig gripper. The screen staging stations may also be configured to secure at least one screen thereto.

To even further achieve the foregoing and other objects in accordance with additional exemplary embodiments of the present invention, a process for delivering a predetermined plurality of screens in a cast iron mold comprises the steps of providing a dispenser apparatus configured to select a predetermined plurality of screens from a stack, selecting the predetermined plurality of screens from the stack, providing a stage setting apparatus configured to position the screens in a selected orientation, positioning the screens in the stage setting apparatus, providing a jig apparatus configured to grip the screens from the stage setting apparatus and configured to align the screens in the mold in a selected orientation, gripping the screens from said stage setting apparatus with the jig, aligning each of the screens gripped by the jig in corresponding relation to a sprue and releasing each of the screens from the jig into the sprue.

Still other embodiments, combinations, advantages and objects of the present invention will become apparent to those skilled in the art from the following descriptions wherein there are shown and described alternative exemplary embodiments of this invention for illustration purposes. As will be realized, the invention is capable of other different aspects, objects and embodiments all without departing from the scope of the invention. Accordingly, the drawings, objects, and description should be regarded as illustrative and exemplary in nature only and not as restrictive.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF EXEMPLARY EMBODIMENTS

Figure 1:
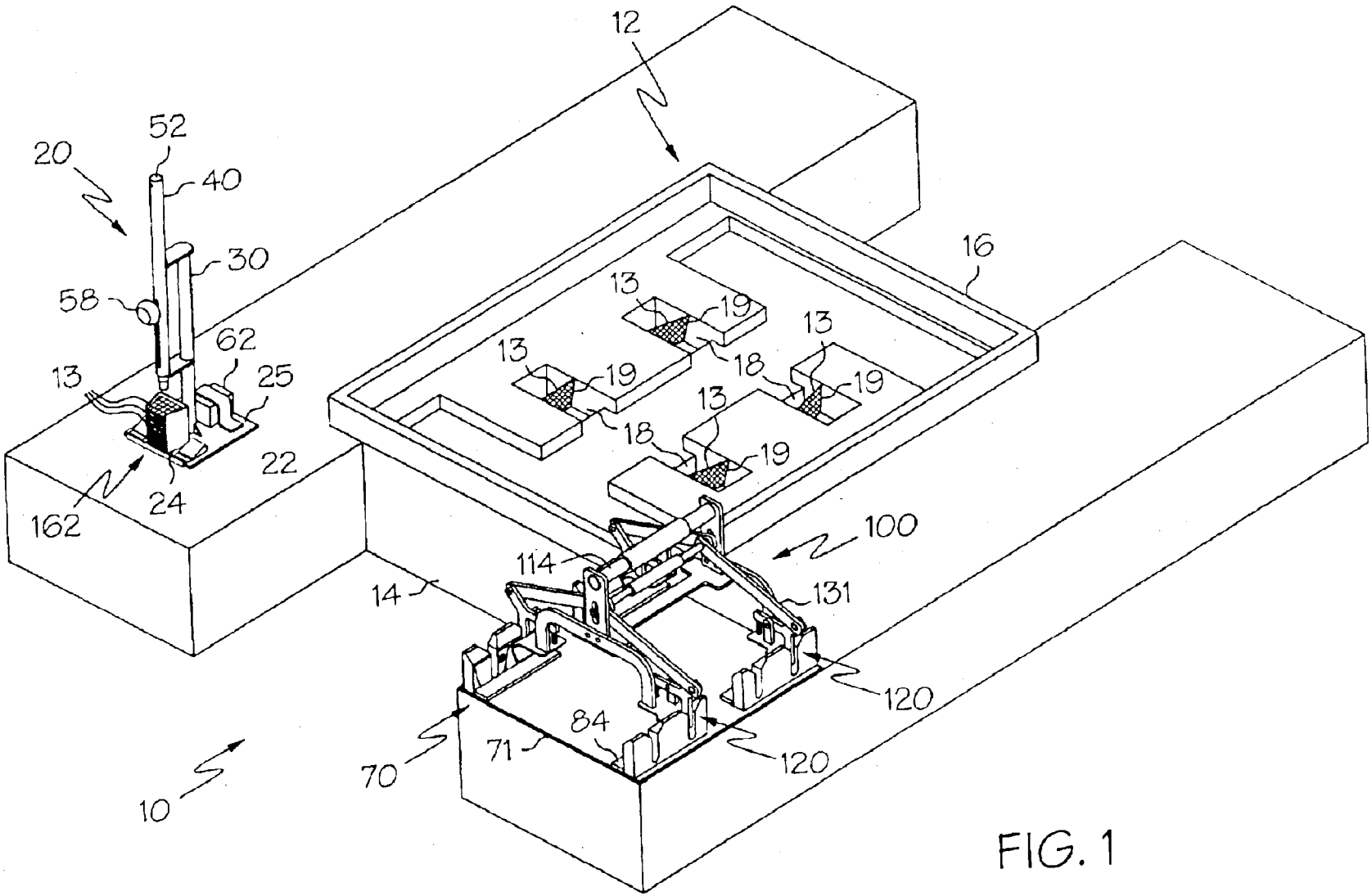
FIG. 1 is a perspective view illustrating an exemplary dispensing arrangement for inserting a part into a mold in accordance with the present invention.

Referring to the drawing figures in detail, wherein like numerals indicate the same elements throughout the drawing figures, FIG. 1 illustrates a dispensing arrangement 10 for positioning a plurality of parts such as screens into a mold 12 such as a mold for casting metal parts. It should be understood that while the present description identifies screens, any variety of parts may be dispensed, staged, gripped and positioned by the present invention. The dispensing arrangement 10 may comprise a parts dispensing apparatus 20 such as for dispensing a plurality of screens 13. As will be explained in further detail below, the screens dispensed by dispensing apparatus 20 may be positioned in a selective orientation in a staging apparatus 70 so that they may be easily gripped, lifted and moved for delivery to a mold by a jig apparatus 100. As illustrated in FIG. 1, the apparatus 10 of the present invention may be conveniently positioned at a workstation 14 adjacent the lower die 16 of the mold 12. Die casting molds often have multipiece arrangements, and the upper or top portion of this exemplary mold has not been shown to simplify this illustration. As described herein, such the dispensing arrangement of the present invention eliminates the need to manually place each screen into the mold 12, and simplifies the mold preparation process for added benefits and efficiencies.

Figure 2:
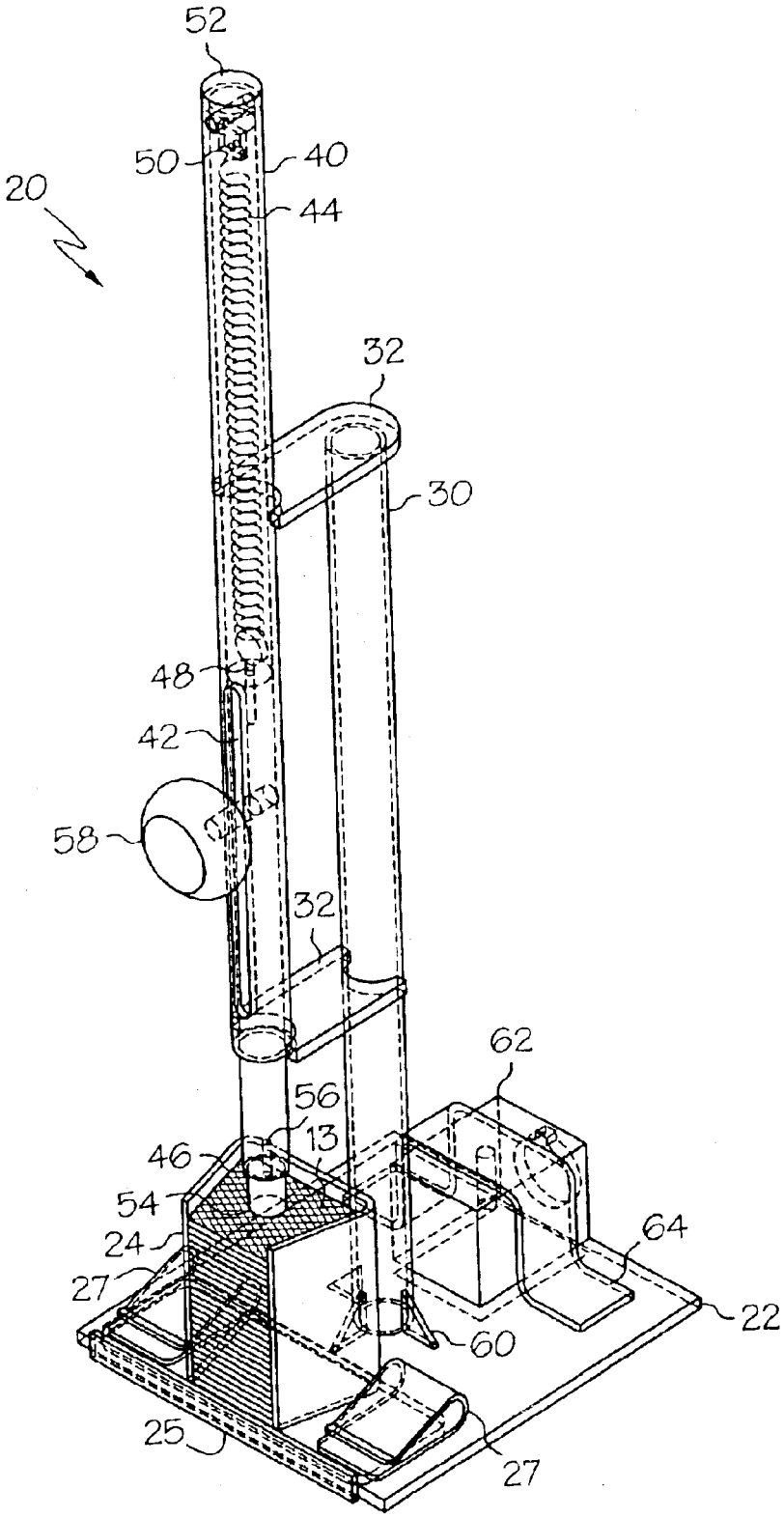
FIG. 2 is a perspective view illustrating an exemplary apparatus for dispensing a part for insertion into a mold in accordance with the present invention.

Referring to FIGS. 1 and 2, a screen dispensing apparatus 20 may comprise a base 22, a column mounting member 30 and a column 40. Base 22 may be provided as a generally flat plate comprised of steel, aluminum or any other durable material. If desired, base 22 may comprise a mounting magnet 62, clamps, or other setups for securing dispenser 20 to a work surface (e.g., workstation 14 in FIG. 1). As best seen in FIG. 2, mounting magnet 62 may be secured to base 22 by, for example, one or more clamps or straps 64.

Extending upwardly from base 22 may be a column mounting member 30 used to support column 40 relative to the base 22. Column mounting member 30 may be a cylindrical hollow tube similarly comprised of steel, aluminum or any other durable material and may be secured to the base 22 by a weld, screw or any other fastening arrangement. If desired, one or more stabilizing members 60 may be associated with column mounting member 30 and base 22 to provide additional support for column 40.

Also associated with the base may be a part reservoir 24 configured to secure a stack or plurality of parts such as screens to be selectively dispensed. Reservoir 24 may be configured to receive and hold any number of screens 13 of any size and shape on base 22. Also, as illustrated in FIGS. 1 and 2, reservoir 24 may be positioned on base 22 so that it is adjacent to column 40. As described later herein, column 40 may comprise components to lift a predetermined plurality of screens 13 out of reservoir 24. If desired, reservoir 24 may be removable from base 22 (e.g. such as in the form of a quick change cartridge) so that another reservoir 24 securing a second stack of screens may be positioned on the base 22 as needed. As illustrated in FIG. 2, reservoir 24 may be mounted to a reservoir base 25 for supporting the plurality of screens thereon. Reservoir base 25 may be selectively removed from clips 27 associated with base 22 so that a second or loaded reservoir 24 may be exchanged. In another embodiment, screens may be automatically reloaded by, for example, any motorized apparatus, or simply manually refueled from the substantially open top of reservoir 24.

As illustrated in FIG. 2, column 40 may be secured to column mounting member 30 by one or more mounting tabs 32. Mounting tabs 32 may be secured to column mounting member 30 and column 40 by a weld, screw or any other fastening arrangement. In another embodiment, column 40 may be secured directly to column mounting member 30 or to base 22.

Column 40 may further carry one or more components configured to selectively "pick" or otherwise attract one or more screens 13 from reservoir 24. For example, column 40 may be reciprocally mounted on member 30, or may further comprise an actuation arm 42 connected to an actuation arm biasing member 44. Actuation arm 42 may be comprised of plastic, steel or any other durable material and may be reciprocally associated with column mounting member 30 through column 40 for selective reciprocation between dispensing and collecting positions.

As indicated herein, the dispensing position is illustrated in FIG. 1 (actuation arm 42 in an upward position), whereas collecting position is illustrated in FIG. 2 (actuation arm 42 in a downward position touching or near the screens). Actuation arm 42 might comprise a cylindrical tube slidably mounted in at least a portion of column 40 and/or mounting member 30. As illustrated in FIG. 2, actuation arm biasing member 44 may comprise an extension spring or coil and may be connected at one end to actuation arm 42 by, for example, pin 48. Actuation arm biasing member 44 may be connected to the column 40 at its opposite end by securing biasing member 44 to locking member 50 associated with a column cap 52. As discussed later herein, actuation arm biasing member 44 may be configured to normally maintain actuation arm 42 in one of either a dispensing or collecting positions.

Actuation arm 42 may also comprise a handle 58 screwed into, secured to or otherwise associated with actuation arm 42. Handle 58 may be used to actuate the actuation arm 42 so as to move it between dispensing and collecting positions. Actuation arm 42 may also comprise a working end 46. A magnet 54 may be associated with the working end 46 and be configured to collect or "pick" a plurality of screens 13 from reservoir 24. In one embodiment, magnet 54 may be secured to actuation arm 42 by a screw 56. In another embodiment, magnet 54 may be secured to actuation arm 42 in a variety of different arrangements including, but not limited to, integrally molding (e.g. by injection molding) actuation arm 42 to embed or otherwise envelope a portion of magnet 54.

Magnet 54 may be advantageously designed to interact with the particular material of the screens (e.g., steel, aluminum, magnesium, alloy, or the like) located in reservoir 24. If desired, magnet 54 may be of such size and strength to automatically magnetically pick up a "predetermined" number of screens from the top of the stack in reservoir 24. In this way, when a worker needs screens for a casting operation, he or she may move the actuation arm 42 from its dispensing position (e.g. shown in FIG. 1) to a collecting position (e.g. as seen in FIG. 2) by pushing downwardly on the handle 58 thereby causing actuation arm 42 to move toward and touch or nearly touch the magnet 54 against the top of the stack of screens in the reservoir 24. By releasing the downward pressure, the actuation arm biasing member 44 will automatically raise the actuation arm 42 with a predetermined number (e.g., four) of parts or screens being magnetically held on the bottom the magnet 54. As the actuation arm 42 rises, it may bring the predetermined number of screens above the reservoir 24 for easy access by the worker. If desired, magnet 54 may be replaced with another magnet capable of selecting more or less than four screens 13.

While FIG. 2 illustrates a dispenser apparatus 20 with a generally vertical column 40 reciprocally mounted to mounting member 30, it is contemplated that the dispenser apparatus 20 of the present invention may exist in a variety of embodiments including, but not limited to a horizontally arranged column 40 and column mounting member 30 on base 22, or providing a biasing member 44 that biases actuation arm 42 downward.

Figure 3:
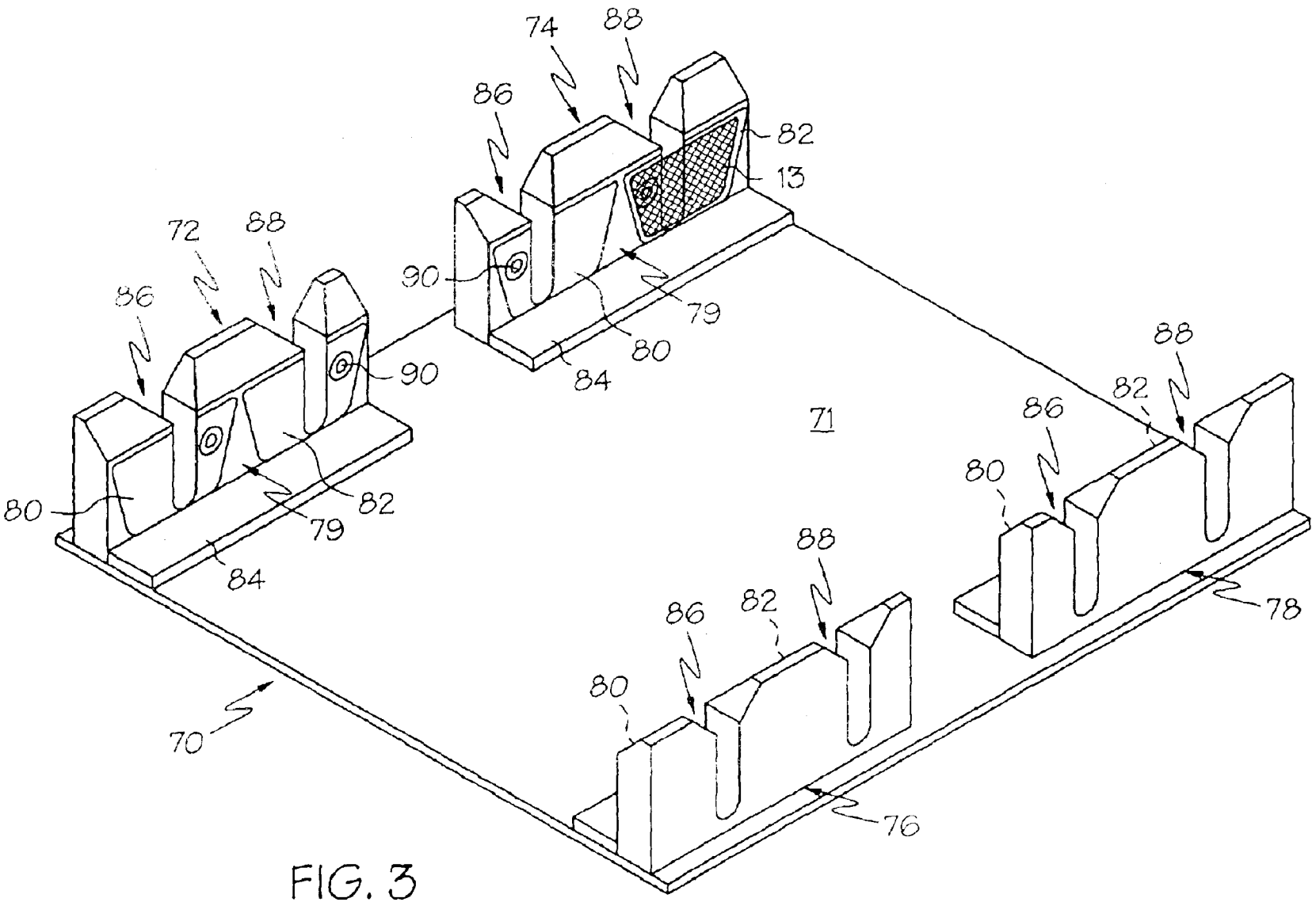
FIG. 3 is a perspective view illustrating an exemplary apparatus for staging parts for insertion into a mold in accordance with the present invention.

Once the worker has obtained the predetermined number (e.g., four) of screens from the dispenser apparatus 20, he or she may then arrange the screens in a screen staging apparatus. Referring to FIG. 3, an exemplary embodiment of a staging or stage setting apparatus 70 is illustrated and may be designed to physically simulate the arrangement of a particular die of the mold and the position, orientation and spacing of each of the screens required for a particular die/mold in their exact required relative locations. For example, staging apparatus 70 may comprise a base 71 with a plurality (e.g. four) of part or screen staging stations 72–78 each configured to stage one or more screens. Staging apparatus 70 may be comprised of steel, plastic, wood or any other durable material. If desired, staging apparatus may be secured to a workstation (e.g., 14 in FIG. 1).

In addition, while FIG. 3 illustrates four separated stations 72–78, it is contemplated that adjacent stations may be combined with one another thereby forming a single station. Also, any number of stations may be associated with base 71 for staging any number of screens. In another embodiment, stations may be removeably or at least adjustably arranged in a variety of fashions on base 71, such as by releasably attaching the stations to base 71 such as with bolts, set screws, clamps or the like.

Referring to stations 72–78, each station may comprise a generally flat plate with one or more recesses (e.g. 80 and 82) formed in the staging face 79. In another embodiment, each station 72–78 may comprise any shape configured to stage any desired part. Recesses 80–82 may be shaped similar to the parts or screens (e.g. 13) sought to be staged so that each screen may be inserted into each recess 80–82 and received in a predetermined alignment and/or orientation. One screen 13 is shown as being temporarily held in a predetermined position and orientation by magnet 90 of station 74 in FIG. 3, as will be discussed further below. In addition, as discussed later herein, the recesses may be shaped similar to the backing plates (122 in FIG. 4) so that the backing plates may be aligned with and/or even be partially inserted into each recess to further insure proper alignment and orientation. Placement of the screen into a recess 80–82, may help create a flush or substantially even surface along the inner or staging face 79 of the station when the screen is inserted. As discussed later, such configuration may be useful to facilitate gripping of the screens with jig apparatus while optimizing more precise pre-alignment and/or orientation of the screen for delivery and insertion in a mold. If desired, base 71 may further comprise a platform 84 associated with each station 72–78 to selectively elevate or vertically align the screen(s) at each station 72–78 in a position adjacent to and corresponding with a particular recess (e.g. 80 and 82).

Figure 5:
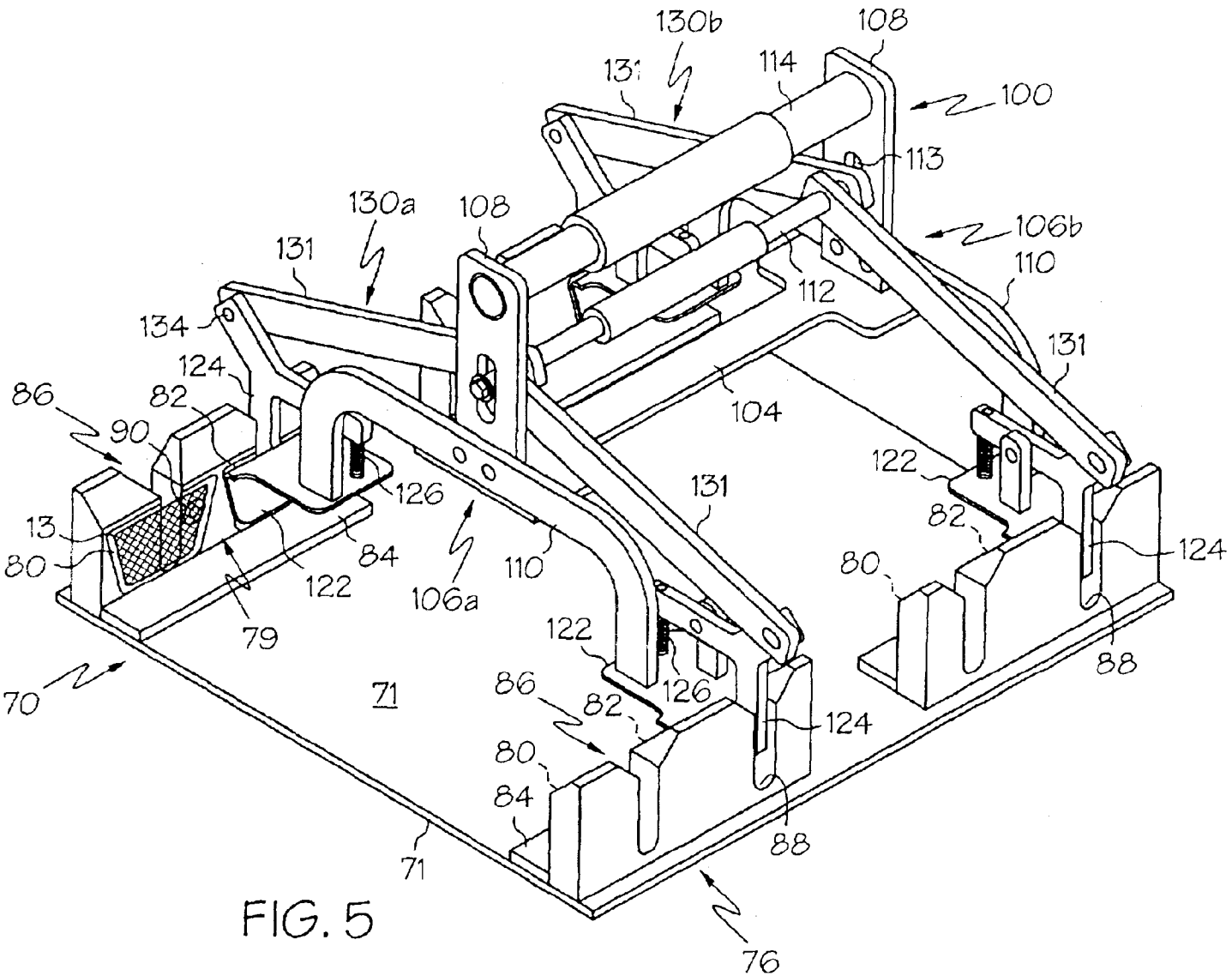
FIG. 5 is a perspective view illustrating the exemplary apparatus of FIG. 4 in a "parked" position on the exemplary apparatus of FIG. 3.

As illustrated, because each station comprises two recesses 80–82, two screens may be staged at each station. Alternatively, and as illustrated in FIG. 1, a worker may utilize only one of the two recesses at each station for screen staging, while initially and temporarily storing or parking the jig apparatus on the staging apparatus adjacent the other recess of each station when not in use, or to allow resting the jig in the staging device while placing screens in the other recess. For example, as illustrated in FIG. 5 the staging apparatus of FIG. 3 may be capable of staging four screens in recesses 80 of the respective stations, wherein the non-used adjacent four recesses 82 may be used to "park" the jig apparatus 100 by temporarily aligning the backing plates 122 of the jig apparatus 100 with corresponding recesses 82. Accordingly, grippers 124 would be accommodated by slots 88 while screens could be placed in recesses 80. Thereafter, jig 100 could be moved to align its backing plates 122 with recesses 80 to grip the screens in proper orientation for delivery and insertion steps. It should be understood, however, that staging apparatus 70 may comprise any number of stations with any number of recesses so configured to stage any desired number of screens and/or corresponding backing plates. For larger screens, for example, more than one backing plate 122 and/or gripper 124 might be appropriate.

Referring again to FIG. 3, each station 72–78 may also comprise a magnet 90 associated with each recess 80–82 to further assist in securing each screen or backing plate (122 in FIGS. 4 and 5) in each recess 80–82. In another embodiment, each station 72–78 may comprise an appropriately shaped (e.g. in the illustrated embodiments a generally flat) surface or staging face 79, with one or more magnets 90 or other securing arrangement capable of selectively positioning and temporarily holding one or more screens thereto, thereby eliminating the need for recesses 80–82.

Referring to station 76 as exemplary of the remaining stations 72–78 for this example only, station 76 may two comprise openings or slots 86 and 88 each configured to accommodate/receive a gripper (124 in FIG. 4) from jig apparatus and allow movement thereof between engaged and disengaged positions without substantial interference or encumbrance. Each slot 86 and 88 may be configured to accommodate one or more grippers of any size and shape. While FIG. 3 illustrates station 76 as comprising two slots 86 and 88, it is contemplated that each station 72–78 may comprise any number of slots depending on the number of screens/jig apparatus desired to be staged.

As discussed later herein, a jig apparatus 100 may remove the screens positioned within the recesses 80–82 of staging apparatus 70 by positioning each of the backing plates (122 in FIG. 4) adjacent to the inner face or staging surface 79 of a respective station (72, 74, 76, 78) of staging apparatus 70, and moving a gripper (124 in FIG. 4) through one of slots 86 or 88 to its engaged position, thereby pinching the screen 13 between the gripper and its corresponding backing plate (e.g. as illustrated in the forward most part of FIG. 4). In another embodiment, jig apparatus may be configured to insert two grippers (i.e. 124 in FIG. 4) through both slots 86–88 thereby picking two screens per station.

Figure 4:
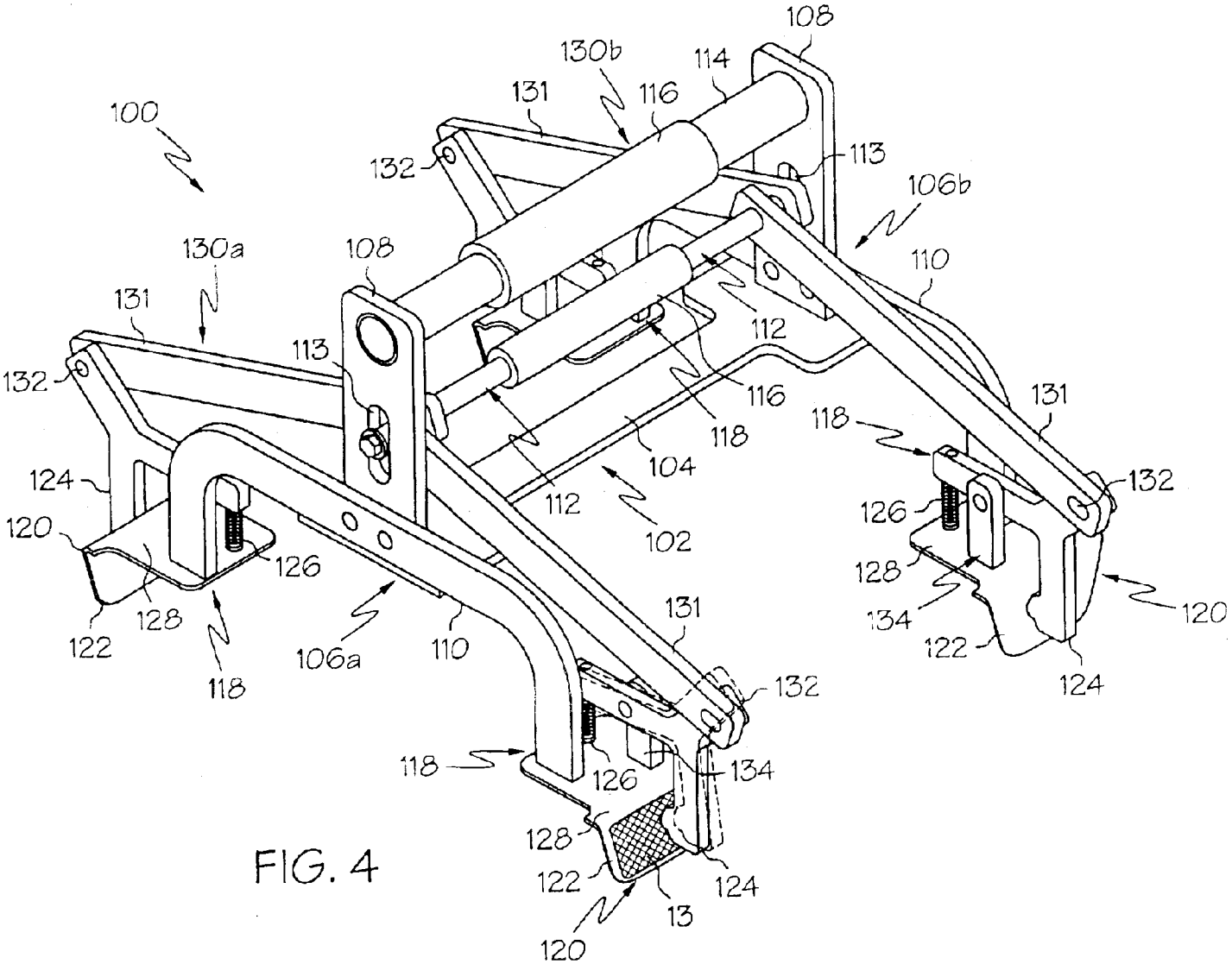
FIG. 4 is a perspective view illustrating an exemplary apparatus for gripping and positioning a part into a mold in accordance with the present invention.

Referring to FIG. 4, as previously indicated, once the worker places each of the screens in the staging apparatus 70, then the worker may lower the jig apparatus 100 onto the screen staging apparatus 70 or move the jig apparatus from its "parked" position on staging apparatus 70, as discussed above (illustrated in FIGS. 1 and 5). Jig apparatus 100 and its components may be comprised of any combination of steel, aluminum, rubber, plastic or other durable materials. Jig apparatus 100 may comprise a frame 102 having a longitudinal chassis 104. As illustrated in FIG. 4, chassis 104 may have a generally I-beam configuration and comprise spaced ends 106*a* and 106*b*. In another embodiment, chassis 104 may comprise any shape configured to secure additional components of jig apparatus 100 thereto.

Chassis 104 may also comprise upwardly extending members or ears 108 positioned adjacent the spaced ends 106*a* and 106*b*. Ears 108 may be welded or otherwise secured to longitudinal chassis 104. As illustrated in FIG. 4, ears 108 may be configured to secure mounting arms 110 to the jig apparatus 100, to receive release assembly 112 and to receive handle 114. The jig apparatus 100 may be carried from one location to another by handle 114. If desired, release assembly 112 and handle 114 may comprise a comfortable and/or protective covering 116 made of foam, rubber or the like. In another embodiment, ears 108 and/or handle 114 may be eliminated. In such embodiment, chassis 104 might be used to both secure mounting arms 110 and carry the jig apparatus 100.

Release assembly 112 may comprise a rod with each of its outer ends associated within a sliding aperture 113 in the ears 108. As illustrated in FIG. 4, release assembly 112 may also be associated with grippers 124 by, for example, two pairs 130*a* and 130*b* of levers 131. Each pair of levers 130*a* and 130*b* may be comprised of two levers 131 pivotally connected to release assembly 112 at their inner ends and secured to a gripper 124 at a linkage pivot 132 adjacent their distal ends. As discussed later herein, the release assembly 112 may be configured to selectively and simultaneously move some or all of the plurality of grippers 124 from an engaged position to a disengaged position.

Mounting arms 110 are shown in this exemplary embodiment as each comprising a U-shaped arm with a node 118 at each distal end. A grip assembly 120 may be secured at the end of each node 118 by a weld or other fastening arrangement. As illustrated in FIG. 4, each grip assembly 120 may comprise a backing plate 122 with a releasable gripper 124 biased against the backing plate 122 by the lever linkage system shown and/or by gripper biasing member 126. In one embodiment, backing plate 122 may be provided in the form of a piece of metal, plastic or other durable material configured to form a substantially right angle defining the backing plate 122 and a platform 128 for supporting other gripper and biasing elements. The shape of the backing plate 122 also allows the jig to function not only as a surface for gripper 124, but also as a sprue cover when the jig 100 is inserted into the die. More particularly, the platform 128 of backing plate 122 may help to prevent debris from a previous shot from entering the sprue as the sprue is cleaned, as will be further described below.

Gripper 124 may similarly comprise a piece of metal, plastic or other durable material and may be configured to straddle the backing plate 122. As illustrated in FIG. 4, gripper 124 may be secured to the jig apparatus at multiple locations. For example, as discussed above, each gripper 124 may be secured to one or more levers 131. Additionally, each gripper 124 may be pivotally connected to a grip mount 134 associated with the platform 128 and/or backing plate 122. Gripper may also be biased against the backing plate 122 by gripper biasing member 126. Also, while FIG. 4 illustrated the jig apparatus 100 comprising four symmetrical gripper assemblies 120, it is contemplated that jig apparatus 100 may be asymmetric and include any number, orientation or spacing of gripper assemblies 120 desired to position one or more screens into a mold.

In use, gripper assemblies 120 may be moved from an engaged position to a disengaged position by actuating release assembly 112 upward. The upward movement of the release assembly 112 within the sliding or operation apertures 113, and causes the levers 131 to pivot the grippers 124 about the gripper mount 134 and against gripper biasing member 126. For illustration purposes, one gripper 124 in FIG. 4 is shown in its disengaged position. Once the jig apparatus 100 is in position over the screens on the staging apparatus, the jig may be moved to its engaged position by releasing the release assembly 112. In this manner, the release assembly 112 moves downwardly in the sliding apertures 113 of ears 108 while the gripper biasing member 126 biases the gripper against a screen 13 and backing plate 122. As such, the jig apparatus 100 of the present invention clamps each screen 13 between a gripper 124 and backing plate 122. If desired, grippers 124 may comprise a knurled or other gripping surface to enhance the ability of the grippers to maintain a screen in a proper position once engaged. The jig apparatus 100 may then be carried by its handle 114 to the die/mold and lowered into position to deliver the screens to particular screen positions (illustrated as 19 in FIG. 1).

While the jig apparatus 100 of the present invention has been illustrated as comprising four gripper assemblies 120, it should be understood that the jig apparatus 100 may comprise any number of gripper assemblies necessary to position a desired number of screens in a mold. As mentioned, any particular gripper assembly 120 may also comprise multiple backing plates and/or grippers, as appropriate to accommodate the intricacies of a particular mold. In addition, it is contemplated that a variety of other embodiments may be utilized to grip a screen from staging device including, but not limited to providing screens in a grove associated with the staging device and gripping the screens with gripping assemblies comprising two opposed backing plates.

As can be appreciated from the discussion above, the improved process of the present invention utilizes the screen dispensing apparatus 20, the staging apparatus 70 and the jig apparatus 100 to simplify the tasks of placing a plurality of screens into a die casting mold and covering the sprue for cleaning. As illustrated in FIG. 1, the steps of delivering a predetermined plurality of screen 13 in a mold 12 such as a mold for casting metal products may comprise first providing a dispenser 20 configured to select a predetermined plurality of screen 13 from a stack 162. The screens may be selected from the stack by actuating handle 58 of dispenser downward so that magnet 54 may attract or "pick" a predetermined plurality of screens 13 (e.g., four). The plurality of attracted screens 13 may be raised by releasing handle 58. A worker may then remove the "picked" screens from the magnet 54. If desired, the worker may repeat the dispensing step to attract more screens (i.e. if the worker desires to fill eight or more recesses of the staging apparatus). In another embodiment, the magnet 54 may be configured to attract any desired number of screens including, but not limited to four or eight.

The worker may then place one screen into appropriate recesses (e.g. 80 or 82) of the staging apparatus. The screens may be at least initially or temporarily held in the recess 80 by, for example, a magnet 90 associated with each station or recess. Once the screens are placed in each recess 82, the worker may actuate the release assembly 112 of the jig apparatus 100 to a disengaged position and lift handle 114 to remove jig 100 from a "parked" position relative to unused recesses of staging apparatus 70 (or moved from a location apart from the staging apparatus) and then lower the jig apparatus 100 adjacent recesses 80 (containing screens) so that the backing plates 122 of the gripper assemblies 120 are then aligned with each recess 82 and each gripper 124 is aligned with each slot 86. The worker may then remove force from the release assembly 112 thereby allowing the gripper assembly 120 to move from its disengaged position to its engaged position.

Moving to engaged position, the screens positioned in the staging apparatus 70 are thereby pinched between the backing plate 122 and the gripper 124 of the jig gripper assembly 120. At this time, the screens are held against the respective backing plates in their predetermined positions, orientations and spacings required for delivery and insertion into corresponding screen positions in the mold. The worker may the lift the jig apparatus 100 off of the staging apparatus 70 by lifting upward on the handle 114 and carry the jig apparatus 100 to deliver the staged screens to the die 16. Once at the die 16, the worker may selectively position the jig apparatus over the die 16 so that each gripper assembly 120 (and the screens held therein) is aligned with a corresponding sprue 18 of the mold, and thereby cover the sprue with backing plate 122 and its platform 128. Upon insertion of jig apparatus 100 into position, the screens are also placed in proper alignment with their respective screen position 19 in a sprue 18. If desired, the worker, having covered each sprue 18 may then clean the die 16. The die 16 may be cleaned free of residue that may remain from the previous molding process with, for example, an air gun or by simply wiping the die 16 clean with a shop rag. Because the backing plate 122 covers the sprue 18, residue is prevented from entering the mold during the cleaning process. Once the optional cleaning process is completed, the worker may then actuate the release assembly 112 thereby releasing the screens into their respective sprues 18 and screen positions 19.

The worker may then position the jig assembly 100 onto the staging device 70 (best illustrated in FIG. 5). While the casting process is being completed, the worker may dispense more screens 13 for placement into the staging apparatus 70 and repeat the aforementioned steps in preparation for the next cycle. This process shortens cycle times between successive casting procedures. Once a casting is completed, the die is opened and the freshly cast part is removed from the die. At this time, the operator can lift the reloaded (i.e. with screens staged and gripped as described) jig by its top handle, carry it into the die and place it in position.

The foregoing description of the various embodiments of the invention has been presented for the purposes of illustration and description. It is not intended to be exhaustive or to limit the invention to the precise form disclosed. Many alternatives, modifications and variations will be apparent to those skilled in the art of the above teaching. For example, the dispensing arrangement in accordance with the present invention may comprise a variety of sizes and shapes configured to set a variety of different screens. Accordingly, while some of the alternative embodiments of the screen setting apparatus have been discussed specifically, other embodiments will be apparent or relatively easily developed by those of ordinary skill in the art.

Accordingly, this invention is intended to embrace all alternatives, modifications and variations that have been discussed herein, and others that fall within the spirit and broad scope of the claims.

What is claimed is:

1. A process for delivering a predetermined plurality of screens into a casting mold comprising the steps of:

(a) providing a dispenser apparatus configured to select a predetermined plurality of screens from a stack;

(b) selecting said predetermined plurality of screens from said stack;

(c) providing a stage setting apparatus configured to position said plurality of screens in a selected orientation;

(d) positioning said screens in said stage setting apparatus;

(e) providing a jig apparatus configured to grip said screens from said stage setting apparatus and configured to deliver and align said screens in said mold in a selected orientation;

(f) gripping said screens from said stage setting apparatus with said jig;

(g) aligning said jig apparatus relative to a casting mold; and (h) releasing each of said screens from said jig into a predetermined portion of said mold.

2. The process of claim 1, further comprising the step of cleaning said mold prior to said releasing step.

3. The process of claim 2, wherein said cleaning step is undertaken after said aligning step.

4. The process of claim 1, wherein said selecting step comprises actuating a biased arm of said dispenser.

5. The process of claim 1, wherein said gripping step comprises moving a releasable gripper of said jig apparatus from a disengaged position to an engaged position.

6. The process of claim 5, wherein said moving step simultaneously grips a plurality of screens positioned on said stage setting apparatus.

7. A process for delivering a predetermined plurality of screens into a casting mold comprising the steps of:

providing a jig apparatus configured to grip said plurality of screens and configured to deliver and align said screens in said mold in a selected orientation;

gripping said screens with said jig;

aligning said jig apparatus relative to a casting mold; and releasing each of said screens from said jig into a predetermined portion of said mold.

8. The process of claim 7, further comprising providing a dispenser apparatus configured to select a predetermined plurality of screens from a stack and selecting said predetermined plurality of screens from said stack.

9. The process of claim 7, further comprising providing a stage setting apparatus configured to position said plurality of screens in a selected orientation, positioning said screens in said stage setting apparatus and gripping said screens from said stage setting apparatus with said jig.

10. The process of claim 7, further comprising the step of cleaning said mold prior to said releasing step.

11. The process of claim 10, wherein said cleaning step is undertaken after said aligning step.

12. The process of claim 8, wherein said selecting step comprises actuating a biased arm of said dispenser.

13. The process of claim 7, wherein said gripping step comprises moving a releasable gripper of said jig apparatus from a disengaged position to an engaged position.

14. The process of claim 13, wherein said moving step simultaneously grips a plurality of screens positioned on a stage setting apparatus.

* * * * *